United States Patent [19]

Ojima et al.

[11] 3,949,180

[45] Apr. 6, 1976

[54] JACK

[75] Inventors: Shin Ojima; Kazuhiko Ohgami; Kanbun Nakaba, all of Yao, Japan

[73] Assignee: Hoshidenki-Seizo Kabushiki Kaisha, Yao, Japan

[22] Filed: Aug. 16, 1974

[21] Appl. No.: 498,019

[30] Foreign Application Priority Data

Sept. 3, 1973 Japan ..... 48-103754[U]

[52] U.S. Cl. ..... 200/51.1

[51] Int. Cl.[2] ..... H01R 13/70

[58] Field of Search ..... 200/51.09, 51.1, 153 W; 339/176 R, 183; 179/96

[56] References Cited

UNITED STATES PATENTS

| | | | |
|---|---|---|---|
| 1,668,583 | 5/1928 | Carter | 339/183 |
| 2,368,914 | 2/1945 | Bowen | 200/51.1 |
| 2,740,857 | 4/1956 | Porland | 200/67 D |
| 2,977,436 | 3/1961 | Haydon | 200/67 D |
| 3,222,473 | 12/1965 | Delhase | 200/153 W |
| 3,418,438 | 12/1968 | Barrett | 200/51.1 |
| 3,536,870 | 10/1970 | Izumi | 200/51.1 |

*Primary Examiner*—David Smith, Jr.
*Attorney, Agent, or Firm*—Elliott I. Pollock

[57] ABSTRACT

A jack is provided in which a movable contact is driven away from a fixed contact upon insertion of a plug and returns into abutting relationship with the fixed contact upon withdrawal of the plug. The movable contact comprises an electrically conductive, rigid body which is rotatably mounted at its one end, and is biased toward the fixed contact by means of a coiled spring. When the plug is inserted, the movable contact is displaced against the resilience of the coiled spring to move away from the fixed contact, while when the plug is withdrawn, the resilience of the coiled spring urges the movable contact into abutting relationship with the fixed contact.

6 Claims, 16 Drawing Figures

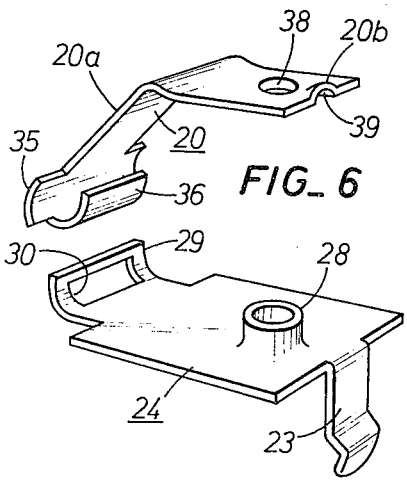
FIG_ 6
FIG_ 7
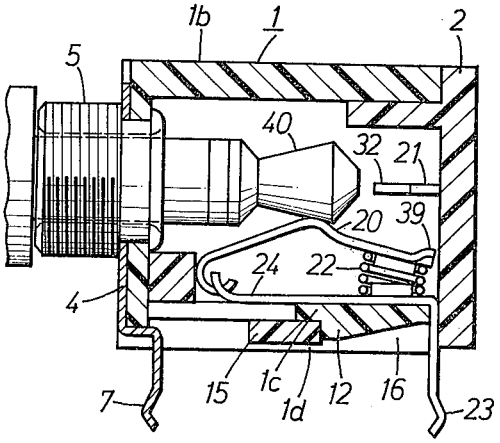
FIG_ 8
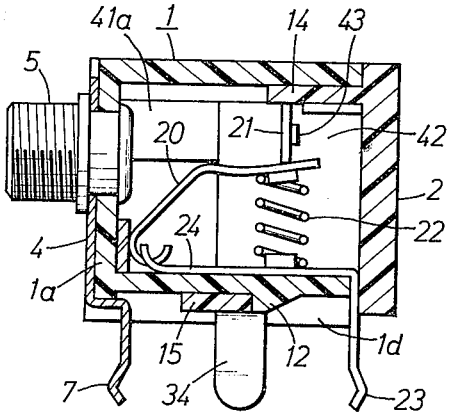
FIG_ 9
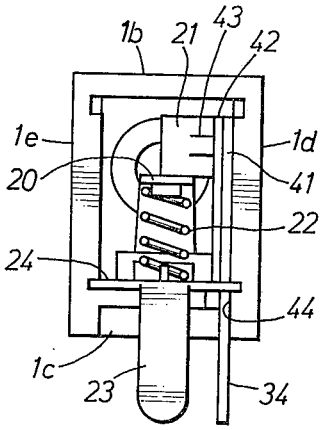
FIG_ 10
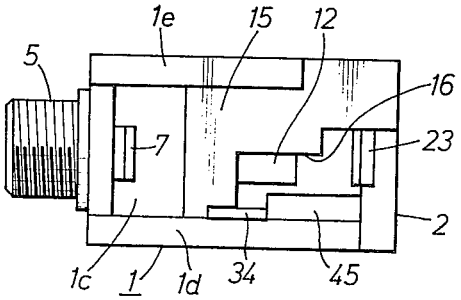
FIG_ 11
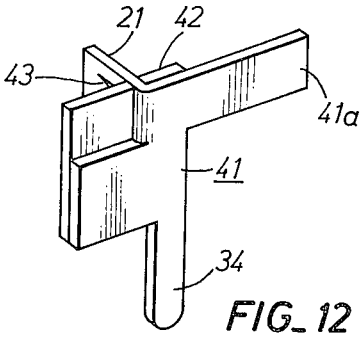
FIG_ 12

JACK

BACKGROUND OF THE INVENTION

The invention relates to a jack for use in a radio or television receiver, taperecorder or the like and having internal contacts which are opened or closed upon insertion or withdrawal of a plug.

A conventional jack has a construction such that when a plug is inserted into the jack, a movable contact made of an electrically conductive, resilient material experiences an elastic deformation due to the plug inserted, thereby moving away from or into contact with a fixed contact. In such a conventional jack, since the movable contact is subjected to an elastic deformation each time the plug is inserted or withdrawn, a repeated insertion or withdrawal of the plug over a number of times results in a fatigue of the movable contact, causing a poor contact and limiting the useful life.

In order to overcome such a disadvantage of a conventional jack, it has been proposed to use a coiled spring which compensates for a reduction in the amount of elastic deformation experienced by the movable contact, thereby increasing the useful life. Such an improved jack is disclosed in U.S. Pat. No. 3,536,870 issued Oct. 27, 1970 and entitled "Jack with spring pressed resilient terminal". In the disclosed jack, a movable contact made from an electrically conductive, resilient material bears against a fixed contact in a resilient manner, and is additionally urged against the fixed contact resiliently by means of a coiled spring in order to increase the pressure of contact. Because a coiled spring is substantially less susceptible to fatigue than the movable contact, the disclosed jack obtaining an increased life as compared with one not incorporating a coiled spring. However, it should be noted that the patent premises the use of the movable contact comprising a resilient material in the similar manner as in the prior art, and the coiled spring is used for the purpose of supplementing the resilience of the movable contact when it is subjected to an elastic deformation. Consequently, the elastic deformation to which the movable contact is subjected upon insertion and withdrawl of the plug, as well as the earlier fatigue of the movable contact which occurs prior to the occurrence of the resilient wear of the coiled spring remain unchanged in this prior art jack, and in effect the insertion or withdrawal of the plug has been limited to the order of 20,000 times at most. In addition, the movable contact is bent in a V-configuration, for example, and it is a relatively difficult operation to press the movable contact of resilient material into such a definite bending angle. This results in variations in the shape of the movable contact formed from product to product, accompanying varying pressure of contact with its associated fixed contact. Where the degree of bending the movable contact is limited, and the movable contact is bent to a further degree to provide a sufficient pressure of contact with its associated fixed contact when it is assembled into the jack, the resulting movable contact will be liable to wear. Furthermore, the movable contact formed of a resilient material and the coiled spring will both experience their natural oscillation in response to an external shock or vibration to result in an unstabilized contact therebetween and also in the occurrence of noises. As another aspect, the movable contact is generally formed with a terminal at its one end which is extended to the exterior of a casing, and consequently, as a whole, it obtains a relatively large dimension. This means that it has a relatively high heat capacity, which may cause a thermal deformation in the casing molded from synthetic resin material when soldering a lead wire to such terminal, thereby resulting in a misalignment in the position or angle of the contacts, and thus disadvantageously producing a defective product. Finally, since a relatively expensive conductive resilient material such as phosphor bronze must be used for the movable contact, in addition to the use of the coiled spring, the cost of the overall assembly increases.

Therefore, it is an object of the invention to provide a long life jack.

It is another object of the invention to provide a jack which has a long life while assuring a sufficient pressure of contact with the fixed contact.

It is a further object of the invention to provide a jack employing a movable contact of a uniform and accurate configuration which can readily be pressed, thus assuring a given pressure of contact and a mechanically stability.

It is an additional object of the invention to provide a jack in which the heat capacity of the terminal for the movable contact is reduced, thereby rendering the casing insusceptible to deformation by soldering and avoiding the susceptibility to a change in the mounting condition of the contact.

It is still another object of the invention to provide a long life jack which assures a sufficient pressure of contact while avoiding the use of an expensive conductive, resilient material for the movable contact, thus enabling the jack to be produced inexpensively.

SUMMARY OF THE INVENTION

In accordance with the invention, a movable contact is rotatably retained at its one end within a casing of an insulating material. The free end of the movable contact bears against a fixed contact under the resilient bias of a coiled spring. A terminal electrically connected with the movable contact through the coiled spring or a retaining element for the movable contact is extended to the exterior of the casing. The movable contact is formed of an electrically conductive, rigid material such as brass rather than a resilient material. When a plug is inserted into the casing, it presses against the movable contact, turning it away from the fixed contact against the bias of the coiled spring. During this process, the movable contact is not subjected to any degree of elastic deformation. As a consequence, the wear of the movable contact presents no problem whatsoever, and the only problem of elastic wear relates to that of the coiled spring, thereby providing a long life to the jack. Since the movable contact does not comprise a resilient material, it can be readily pressed into an accurate configuration without producing a defective product, and a sufficient pressure of contact is assured. In addition, the assembling operation is also facilitated. Because the movable contact and a terminal therefor are separate from each other, the heat capacity of the terminal is reduced, avoiding adverse influences of soldering. A plurality of combinations, each comprising the fixed contact and the rigid, movable contact which is biased toward it by the coiled spring, may be received within a single jack casing so as to operate all of these simultaneously upon insertion and withdrawal of the plug.

BRIEF DESCRIPTION OF THE DRAWINGS

FIG. 6 is a perspective view of a movable contact;

FIG. 7 is a perspective view of a stationary plate;

FIG. 8 is a cross section similar to FIG. 4, illustrating the plug inserted;

FIG. 9 is a cross section showing a second embodiment of the jack according to the invention;

FIG. 10 is a rear view of FIG. 9 with the rear plate being removed;

FIG. 11 is a bottom view of FIG. 9;

FIG. 12 is a perspective view of a fixed contact and a retaining member therefor;

DETAILED DESCRIPTION OF PREFERRED EMBODIMENTS

Figure 1:
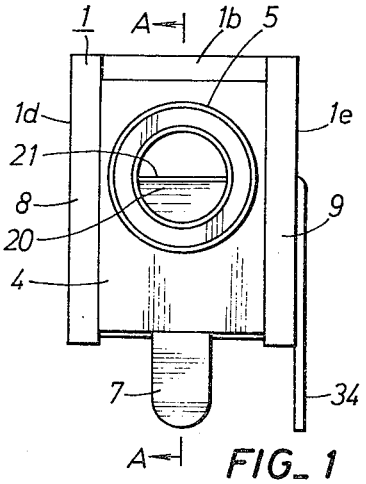
FIG. 1 is a front view showing a first embodiment of the jack according to the invention.
Figure 2:
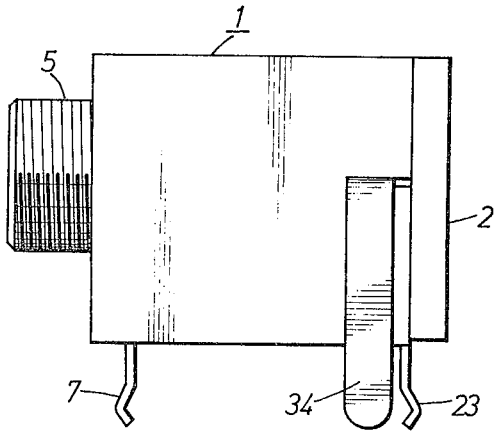
FIG. 2 is a right-hand side elevation thereof.

Referring to FIGS. 1 to 5 which show one embodiment of the jack according to the invention, a casing 1 may be moulded from synthetic resin into a rectangular configuration including a front plate 1*a*, top plate 1*b*, bottom plate 1*c*, left-hand side plate 1*d*, and right-hand side plate 1*e*, all of which are integrally formed, with a rear plate 2 being detachably mounted. A central opening 3 is formed in the front plate 1a of the casing 1, and covering the front plate 1a is a metallic ground plate 4 in which an opening aligned with the central opening 3 is formed. A cylindrical plug-receiving member 5 formed of a metal is mounted on the casing 1 in communication with the central opening 3 so as to extend forwardly thereof. The rear end of the plug-receiving member 5 has a reduced outer diameter and a reduced wall thickness thereby forming a step 6 between the reduced wall portion and the remainder of the member 5. Specifically, the reduced wall portion is passed through the central bore in the front plate 1*a* and that in the ground plate 4, and after the member 5 is fitted into the casing to a position such that the step 6 abuts against the ground plate 4, the inner end is forced outwardly to be caulked against the inner surface of the front plate 1*a*, thus securing the ground plate 4 and the plug-receiving member 5 in place on the front plate 1a of the casing. The plug-receiving member 5 may be threaded in its outer periphery as required. The lower edge of the ground plate 4 is bent to extend along the outer surface of the bottom plate 1*c* for a small distance, with a ground terminal 7 being integrally formed and extending downwardly from its central portion. The front plate 1*a* is integrally formed with a pair of ribs 8 and 9 along its both lateral sides so as to prevent a rotation of the ground plate 4, by holding it between the ribs 8, 9.

Figure 5:
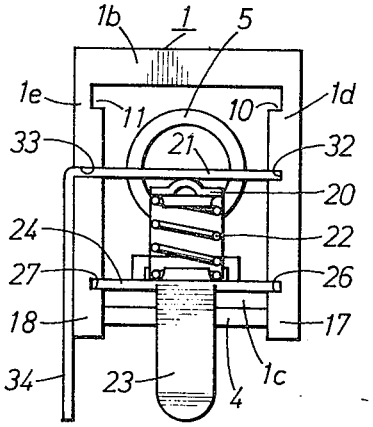
FIG. 5 is a rear view of FIG. 1 with the rear plate being removed.
Figure 3:
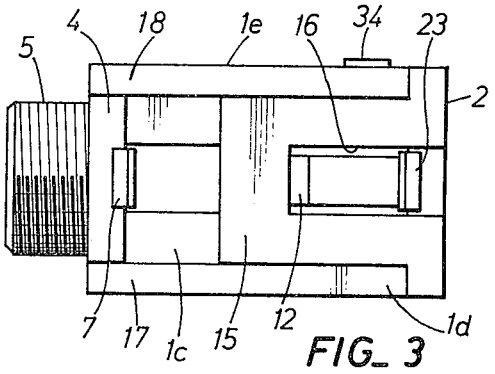
FIG. 3 is a bottom view of FIG. 2.

A pair of grooves 10 and 11 adjoining with the inner surface of the top plate 1*b* are formed in the inner surface of the both side plates 1*d* and 1*e*, extending from the rear end forwardly, as shown in FIG. 5. A detent projection 12 is integrally formed centrally with the bottom plate 1*c*. The rear plate 2 is integrally formed with a tab 14 on its inner surface, the tab having its both limbs extending through the grooves 10, 11 and guided thereby. The rear plate 2 is also integrally formed with a detent piece 15 which bears against the outer surface of the bottom plate 1*c*. The detent piece 15 is formed with a longitudinally elongate opening 16 which extends to the rear plate 2. When the tab 14 is inserted into the grooves 10, 11 and the rear plate 1*c* is moved forwardly so as to slide the detent piece 15 along the bottom plate 1*c*, thus covering the rear portion of the casing 1, the detent piece 15 will be slightly deformed elastically until its end has moved past the detent projection 12, whereupon the projection 12 will be engaged with the opening 16, thus achieving an engagement between the detent piece 15 and the projection 12 to secure the rear plate 2 to the remainder of the casing 1. Along its opposite lateral sides, the bottom plate 1*c* is integrally formed with a pair of ribs 17, 18 which hold the detent piece 15 as sandwitched therebetween, thus guiding it when the rear plate 2 is fitted and also stabilizing the mounting of the rear plate 2*c*.

Figure 4:
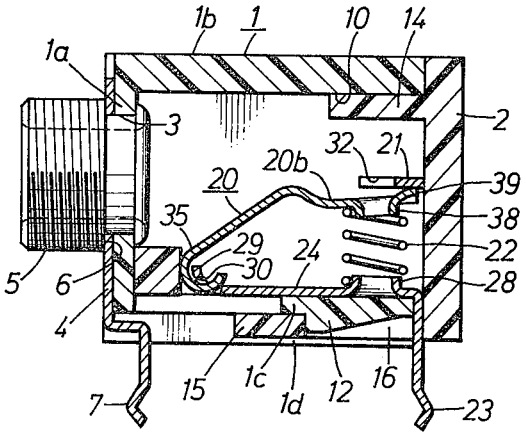
FIG. 4 is a cross section taken along the line A—A shown in FIG. 1.

A movable contact 20 is housed within the casing 1 so as to be rotatable at its one end, while the other end is disposed opposite to a fixed contact 21, and is urged against the fixed contact 21 by a coiled spring 22. The movable contact 20 is electrically connected with a terminal 23 which extends to the exterior of the casing 1. At this end, a metallic stationary plate 24 is mounted in contact with the inner surface of the bottom plate 1*c*. As shown in FIG. 5, guide grooves 26, 27 are formed in the inner surface of the lef-hand and right-hand side plates 1*d*, 1*e* and extends from the rear end forwardly, and the lateral edges of the stationary plate 24 received in these guide grooves 26, 27 to be secured in the casing 1. As shown in FIGS. 4 and 7, the terminal 23 is formed by an extension folded from the rear end of the stationary plate 24, it being noted that such rear end is held in place by the rear plate 2. A hole is formed centrally in the stationary plate 24 by graving from the side of the bottom plate 1c toward the top plate so as to form an annular projection 28 around the periphery of the hole. The coiled spring 22 is positioned by fitting its one end around the outer periphery of the projection 28 in a manner winding around it. The forward portion of the stationary plate 24 is bent upwardly so as to form an arcuate configuration which is convex toward the front, thus providing a retaining section 29. A slot 30 is formed in the central region of the retaining section 29 for the purpose of engagement. The retaining section 29 is in the form of part of a cylinder.

Intermediate their height, the left-hand and the right-hand side plates 1*d* and 1*e* are formed with longitudinally extending grooves 32 and 33, respectively, into which the lateral edges of the fixed contact 21 are inserted to be held in place. One lateral end of the fixed contact 21 extends through a slot communicating with the groove 33 to the exterior of the casing 1, and is thereafter bent to extend around the outer surface of the right-hand side plate 1*d* to provide a fixed terminal 34. As shown in FIGS. 4 and 6, one end of the movable contact 20 is rounded to form part of a cylinder, thereby providing a pivotal connection 35 which extends along the outer surface of the retaining section 29 of the stationary plate 24 so as to permit a rotation of the movable contact 20 about the common axis of the retaining section 29 and the pivotal connection 35. To assure a reliable engagement, the pivotal connection 35 has a partial extension which forms an engaging piece 36 adapted to be inserted into the slot 30 formed in the retaining section 29. The movable contact 20 includes a portion 20*a* which assumes an inclined position extending from the pivotal connection 35 in a rearward and upper direction, and a horizontal portion 20*b* which extends rearwardly from the distal end of the portion 20*a* substantially parallel to the bottom plate 1*c*. The horizontal portion 20*b* is located opposite the lower surface of the fixed contact 21. The horizontal portion 20*b* is centrally formed with a hole which is produced by graving from the top side toward the bottom plate 1*c* so as to form an annular rib 38. The coiled spring 22 is positioned by fitting its other end over the outside of the rib 38 in a manner winding around it. Thus the coiled spring 22 is located between the oppositely disposed stationary plate 24 and the movable contact 20, and resiliently urges the movable contact 20 against the fixed contact 21, thus assuring a good contact therebetween. To further improve such contact, the free end of the movable contact 20 may be stamped toward the fixed contact 21 to form a small projection 39, thus causing the projection 39 to bear against the fixed contact 21. The both contacts 20 and 21 and the stationary plate 24 may comprise a rigid material such as brass, for example. All these elements are manufactured by a press operation. Where the spring 22 is electrically conductive, the movable contact 20 is electrically connected with the terminal 23 through the spring 22, in addition to the path including the stationary plate 24.

In operation, when a plug 40 is inserted into the jack casing 1 through the plug receiving member 5 as indicated in FIG. 8, the plug 40 urges the movable contact 20 toward the bottom plate 1*c*, thus forcing the movable contact 20 to rotate about the retaining portion 29 against the bias of the coiled spring 22 and thus away from the fixed contact 21. When the plug 40 is withdrawn, the resilience of the coiled spring 22 causes movable contact 20 to be restored into abutting relationship with the fixed contact 21. In this manner, the insertion or withdrawal of the plug 40 controls the electrical connection and disconnection between the contacts 20 and 21.

FIGS. 9 to 11 show another embodiment of the jack according to the invention. Parts corresponding to those shown in FIGS. 1 to 8 are designated by like reference characters. In the present embodiment, the fixed contact 21 has its major surface disposed substantially parallel to the front plate 1*a*. As indicated in FIG. 12, the fixed contact 21 comprises a metal plate 41 which is disposed contiguous with the inner surface of the left-hand side plate 1*d*, with its rear portion which is located toward the top plate 1*b* being folded at right angles to provide the fixed contact proper, while the top portion of the forward end is extended forwardly, such extension 41*a* abutting against the inner surface of the front plate 1*a*. Additionally, a fixed terminal 34 depends downwardly from the lower edge of the metallic plate. On the side remote from the left-hand side plate 1*d*, the metal plate 41 is superimposed with an insulating plate 42 which prevents an electrical contact between the metal plate 41 on one hand and the movable contact 20 and the stationary plate 24 on the other hand. A notch is formed centrally in the top edge of the insulating plate 42, and the fixed contact 21 proper is fitted into the notch, with a claw 43 formed in the fixed contact 21 urging the insulating plate 42 against the metal plate 41. The bottom plate 1*c* is formed with a groove 44 which extends from the rear end in the forward direction to guide the fixed terminal 34, and the rear plate 2 blocks the groove 44 and is integrally formed with a tab 45 which holds the terminal 34 against the end of the groove 44. Such configuration can be considered as equivalent with the provision of a slit in communication with the opening 16 for passing the terminal 34 in the detent piece 15 of the rear plate 2 in the embodiment shown in FIGS. 1 to 5.

Figure 13:
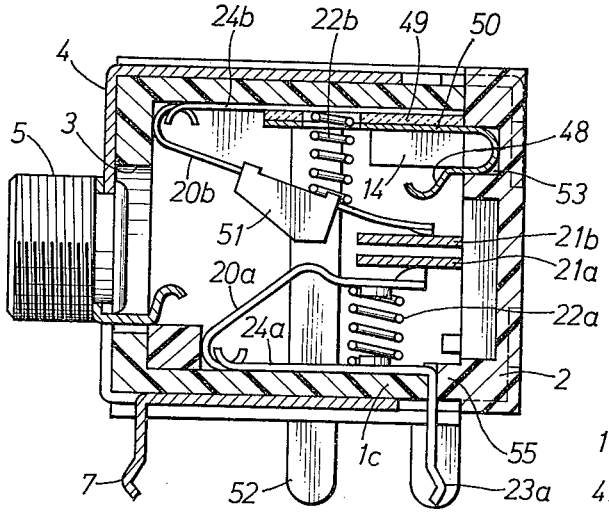
FIG. 13 is a cross section showing a third embodiment of the jack according to the invention.
Figure 15:
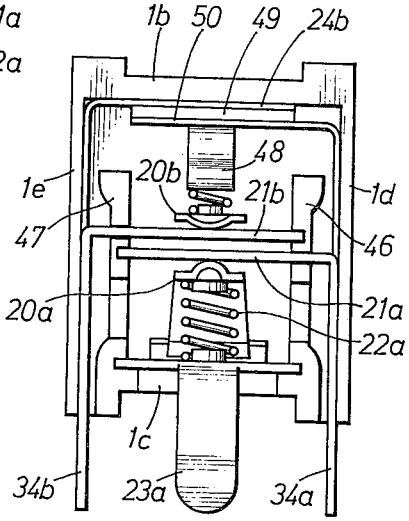
FIG. 15 is a bottom view of FIG. 13.
Figure 14:
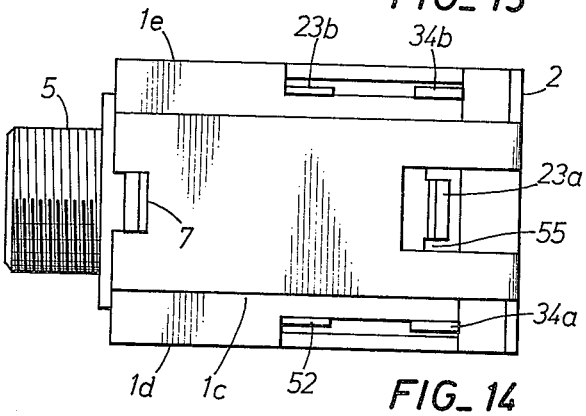
FIG. 14 is a rear view thereof with the rear plate being removed.

While in the preceding embodiments, only one set of movable contact and fixed contact is provided so as to be controlled by the insertion and withdrawal of the plug, it is also possible to provide a plurality of sets of such contacts within a single casing. Referring to FIGS. 13 to 15, the casing 1 houses a set of movable contact 20*a* and fixed contact 21*a* and also another set of movable contact 20*b* and fixed contact 21*b*. Specifically, the movable contact 20*a* and fixed contact 21*a* are located within the casing 1 on the side nearer the bottom plate 1*c* of the axis of the plug-receiving member 5, while the movable contact 20*b* and fixed contact 21*a* are located on the side nearer the top plate 1*b*. As in the preceding embodiments, the stationary plate 24*a* is mounted along the inner surface of the bottom plate 1*c*, and has its terminal 23*a* extending through the bottom plate 1*c* to the exterior of the casing. A pair of support members 46 and 47 are disposed opposite to the inner surface of the left-hand and right-hand side plates 1*d* and 1*e*, respectively, intermediate their length, and their forward end are integrally unified with the casing 1. A pair of longitudinally extending grooves are formed in the support members 46 and 47 for retaining the opposite ends of the fixed contact 21*a* which runs parallel to the bottom plate 1*c*, with one end of the fixed contact 21*a* extending through the space between the support member 46 and the left-hand side plate 1*d*, and being bent along the left-hand side plate 1*d* to be extended to the exterior of the casing 1 to provide a fixed terminal 34*a*. The movable contact 20*a* is disposed opposite to the fixed contact 21a and the stationary plate 24*a*, and is urged into abutting relationship with the fixed contact 21*a* by a coiled spring 22*a* which is located between the contact 20*a* and the stationary plate 24. Another stationary plate 24*b* is mounted along the inner surface of the top plate 1*b* of the casing 1, and the fixed contact 21*b* disposed opposite to the stationary plate 24*b* and the fixed contact 21*a* has its opposite ends received in the grooves in the support members 46 and 47 to be retained thereby. One end of the movable contact 20*b* is rotatably held by one end of the stationary plate 24*b*, while its other end is disposed opposite to the fixed contact 21*b*. A coiled spring 22*b* is disposed between the movable contact 20*b* and the stationary plate 24*b* to urge the movable contact 20*b* into abutting relationship with the fixed contact 21*b*. One end of the fixed contact 21*b* extends through the space between the support member 47 and the right-hand side plate 1*e* to be extended externally to provide a terminal 34*b*. At a position forwardly of the terminal 34*b*, an extension from the stationary plate 24*b* is passed through the space betweeen the support member 47 and the right-hand side plate 1*e* to extend downwardly and externally of the casing 1 to provide a terminal 23*b*.

In the present embodiment, when the plug is inserted into the jack to move the movable contact 20*a* away from the fixed contact 21*a* and also move the movable contact 20*b* away from the fixed contact 21*b*, one of the movable contacts, 20*b*, is adapted to be brought into contact with a third fixed contact 48. At this end, an electrically conductive, U-shaped plate 50 is disposed over the stationary plate 24*b* with a U-shaped insulating plate 49 interposed therebetween, the rear portion of the U-shaped plate 50 being folded back to provide the third fixed contact 48. The free end of the fixed contact 48 is located on the opposite side from the fixed contact 20*b* with respect to the movable contact 21*b*. When the plug is inserted, the movable contact 20*b* is moved against the bias of the coiled spring 22*b* away from the fixed contact 21*b* and resiliently forced into abutting relationship with the fixed contact 48. In order to avoid the electrical communication of the movable contact 20*b* and the fixed contact 48 with the movable contact 20*a* through the plug inserted, the movable contact 20*b* is provided, intermediate its length, with a drive member 51 of an insulating material so that upon insertion of the plug, the drive member 51 is driven to urge the movable contact 20b. It is to be understood that the insulating plate 49 and the U-shaped plate 50 can be received in the grooves formed in the inner surfaces of the both side plates, together with the stationary plate 24*b*. At a position forwardly of the terminal 34*a*, an extension from one lateral edge of the U-shaped plate 50 is bent downwardly to extend through the space between the left-hand side plate 1*d* and the support member 46 to the exterior of the casing, thereby providing a terminal 52. A recess 53 is formed in the inner surface of the rear plate 2 for positioning the bend between the U-shaped plate 50 and the fixed contact 48 therein. The rear plate 2 is integrally formed with a pair of ribs 14 which are fitted between the top plate 1*b* and the support members 46, 47 for holding the both lateral edges of stationary plate 24*b*, insulating plate 49 and the U-shaped plate 50. A projection 55 integrally formed with the inner surface of the rear plate 2 at its lower portion is fitted into a recess formed in the rear end face of the bottom plate 1*c*, thereby retaining the terminal 23*a* in position. In the present embodiment, the plug-receiving member 5 is caulked with the grooved plate 4 rather than to the front plate 1*a*, and the upper and lower edges of the grooved plate 4 are folded back to extend rearwardly along the outer surface of the top plate 1*b* and the bottom plate 1*c*, respectively, such extensions being integrally formed with claws engaging the rear surface of the rear plate 2 to mechanically secure the grooved plate 4, casing 1 and rear plate 4 together.

Figure 16:
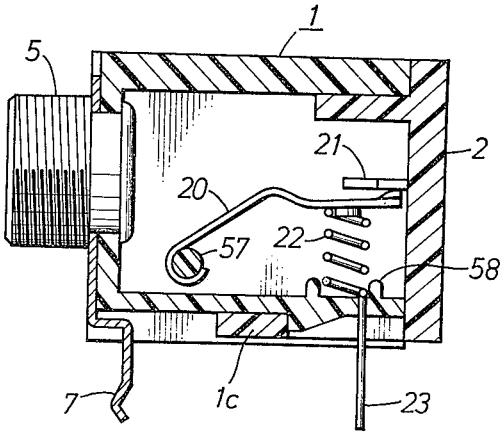
FIG. 16 is a cross section showing a fourth embodiment of the jack according to the invention.

As indicated in FIG. 16, in an alternative arrangement, the stationary plate 24 may be omitted and a pin 57 may be integrally secured to one of the side plates so as to nestingly engage one end of the movable contact 20, thereby allowing a free rotation of the movable contact 20 about the pin 57. One end of the coiled spring 22 which is located nearer the bottom plate 1*c* may be extended to the exterior of the casing to provide the terminal 23. An annular projection 58 may be integrally formed with a bottom plate 1*c* for the purpose of positioning the coiled spring 22. In this alternative embodiment, a metal plate may be interposed between the coiled spring 22 and the bottom plate 1*c*, and terminal 23 may be connected with such metal plate.

As a further alternative, the engagement between the stationary plate 24 and the movable contact 20 may be such that the movable contact is formed with an opening for engagement with an engaging piece formed on the stationary plate 24. It will be appreciated that the positoning means for the coiled spring is not limited to an annular projection or rib, but may be a simple abutment punched out from the material of the associated body.

To summarize, in accordance with the invention, the movable contacts 20, 20*a*, 20*b* are formed of a rigid, conductive material such as brass instead of a resilient material. This cuts down the cost, and also permits a mass production into an accurate configuration through a press operation. The assembling operation is facilitated, and the possibility of causing a poor contact is avoided. Since the movable contact is not subjected to an elastic deformation upon insertion and withdrawal of the plug, no wear need be concerned. The pressure of contact of the movable contact with respect to its associated fixed contact as well as the resumption after displacement are assured only by the coiled springs 22, 22*a*, 22*b*. Since a coil spring is almost insusceptible to wear, a long life, for example, a repeated use in excess of 50,000 times, is possible. Furthermore, since the movable contact comprises a rigid body which is not intended for an elastic deformation and the terminal 23 is mechanically separate from such contact, the heat capacity of the terminal 23 is reduced, so that the deformation of the casing 1 due to the heat upon soldering a connection to the terminal 23 is avoided, thus assuring an accurate positioning of the terminal components and eliminating the possibility of producing a defective product. In addition, the use of a rigid body for the movable contact prevents a vibration from occurring as a result of an elastic deformation when subjected to an external vibration, and thus is more stabilized to external vibrations than the combination of a movable contact comprising a resilient material and a coiled spring, and also produces corresponding reduction in the noises generated.

Having described the invention, what is claimed is:

1. A jack comprising a parallelepiped casing fabricated of an insulating material, a plug insertion section mounted in a central opening formed in a front panel of the casing for detachably receiving a plug, a movable contact within said casing, said movable contact comprising an electrically conductive rigid body, one end of which is pivotally mounted in said casing, said movable contact being positioned to be pivoted about its said one end upon insertion and withdrawal of the plug, a fixed contact fixedly mounted in the casing, a metallic stationary plate secured to the interior of said casing on the side of said movable contact opposite to said fixed contact and located in opposing relationship to said movable contact, and a coiled spring disposed between said stationary plate and said movable contact for resiliently urging said movable contact against said fixed contact, said stationary plate having its major surface located contiguous with the inner surface of a bottom plate of the casing which extends at right angles to the front panel, said stationary plate being provided with an annular projection adjacent to one end thereof remote from said plug insertion section, one end of said coiled spring being wound around said annular projection, the other end of said stationary plate being arcuately bent away from the bottom plate of said casing thereby to form a retaining section, an engagement slot formed in said retaining section, said stationary plate being provided with a terminal which extends through the casing to the exterior thereof, said movable contact having a horizontal portion which extends substantially parallel to said stationary plate, a further annular projection in said horizontal portion extending toward said stationary plate, the other end of said spring being wound around said further annular projection to urge said horizontal portion of said movable contact against said fixed contact, said movable contact also having an inclined portion which extends forwardly from said horizontal portion toward said stationary plate, the free end of said inclined portion being bent into an arc which extends around the outer periphery of said retaining section and said free end having an engaging piece which engages said engagement slot, thereby forming a pivotal connection between said movable contact and said stationary plate to pivotally mount said movable contact in said casing, the arrangement being such that upon insertion of a plug, the plug abuts against said inclined portion to cause said movable contact to rotate about the point of engagement between the engaging piece and the engagement slot in a direction away from the fixed contact against the bias of the spring.

2. A jack according to claim 1 in which the rear of the casing is closed by a separate rear plate, the casing further include right and left side plates which are each formed with a longitudinally extending groove intermediate their vertical height, said fixed contact having its opposing lateral edges received in said grooves to retain said fixed contact in the casing, one end of said fixed contact having a portion extending through one of said grooves to the outside of the associated side plate and a further portion which extends alongside said side plate to provide a fixed terminal.

3. A jack according to claim 2 in which the right and left side plates of the casing are each formed with a guide groove in its inner surface which is contiguous with the bottom plate, the guide grooves extending longitudinally from the rear of the casing, the stationary plate having its opposing lateral edges received in said guide grooves to retain said stationary plate in the casing.

4. A jack according to claim 3 in which both side plates of the casing are formed with a pair of further grooves in their inner surface which are contiguous with a top plate, said further grooves extending longitudinally from the rear of the casing, the bottom plate of the casing being integrally formed with a detent projection centrally on its outer surface, said rear plate being integrally formed with a pair of tabs adapted to be received into said pair of further grooves and having a detent member adapted to bear against the outer surface of the bottom plate, said detent member being formed with a longitudinally elongate slot which receives said detent projection for locking the rear plate to said casing.

5. A jack according to claim 1 in which a metal plate is disposed in abutting relationship with the inner surface of a side plate of the casing, said metal plate having its upper, rear portion bent at right angles to provide said fixed contact, and said metal plate having its lower portion extended through the bottom plate of the casing to the exterior thereof to provide a fixed terminal.

6. A jack according to claim 1 including a first stationary plate fixedly disposed against one inner surface of the casing, a first movable contact fabricated of a rigid body disposed in opposing relationship to said first stationary plate and rotatably engaging one end thereof, a first fixed contact fixedly mounted within the casing on the opposite side of the first movable contact from the first stationary plate, a first coiled spring interposed between the first stationary plate and the first movable contact for biasing the latter against the former, a second stationary plate disposed against an inner surface of the casing which is located opposite to said one inner surface, a second movable contact fabricated of a rigid body disposed in opposing relationship to the second stationary plate and rotatably engaging one end thereof, a second fixed contact fixedly mounted within the casing on the opposite side of the second movable contact from the second stationary plate, the second fixed contact being spaced from the first fixed contact, and a second coiled spring interposed between the second stationary plate and the second movable contact for biasing the latter against the former.

* * * * *